US010018364B2

(12) United States Patent
Yantis et al.

(10) Patent No.: US 10,018,364 B2
(45) Date of Patent: Jul. 10, 2018

(54) OVEN APPLIANCE WITH DUAL OPENING AND CLOSING DOORS

(75) Inventors: John Adam Yantis, Prospect, KY (US); John Mark Chilton, Campbellsburg, KY (US); Scott Thomas Kershner, LaGrange, KY (US); Eric Sugalski, Malvern, PA (US); David Schoon, Somerville, MA (US); David Perry, Cambridge, MA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1140 days.

(21) Appl. No.: 13/613,927

(22) Filed: Sep. 13, 2012

(65) Prior Publication Data

US 2014/0070681 A1 Mar. 13, 2014

(51) Int. Cl.

| | |
|---|---|
| ***F24C 15/04*** | (2006.01) |
| ***E05D 7/02*** | (2006.01) |
| ***F24C 15/02*** | (2006.01) |

(52) U.S. Cl.

CPC ..... *F24C 15/023* (2013.01)

(58) Field of Classification Search

USPC ..... 126/192, 190, 194, 197, 198, 200, 340; 49/475.1, 483.1, 484.1, 368, 367, 108, 49/110, 111, 112, 114; 312/109, 138.1, 312/326, 139, 319.8, 319.7, 319.6, 319.5, 312/319.4, 319.3, 319.2, 319.1, 325, 324, 312/405, 409

See application file for complete search history.

(56) References Cited

U.S. PATENT DOCUMENTS

| | | | | | |
|---|---|---|---|---|---|
| 1,410,887 | A * | 3/1922 | Capozza | F23M 7/00 | 110/177 |
| 1,597,166 | A * | 8/1926 | Meyercord | E06B 7/22 | 49/401 |
| 2,950,911 | A * | 8/1960 | Muffly | F25D 23/02 | 49/108 |
| 3,009,458 | A * | 11/1961 | Pearce | A47B 96/16 | 126/190 |
| 3,249,968 | A * | 5/1966 | Whitehurst | B65H 67/0428 | 19/159 A |

(Continued)

FOREIGN PATENT DOCUMENTS

| | | | | |
|---|---|---|---|---|
| GB | 597549 A | * | 1/1948 | B60B 15/18 |
| JP | 2009228891 | * | 3/2008 | F16H 55/08 |
| RU | 2194868 C2 | * | 12/2002 | F01C 1/077 |

*Primary Examiner* — Steven B McAllister
*Assistant Examiner* — Desmond C Peyton
(74) *Attorney, Agent, or Firm* — Dority & Manning, P.A.

(57) ABSTRACT

An oven appliance with a cabinet that defines a chamber for cooking food items is provided. A pair of doors is rotatably mounted to provide selective access to the chamber of the cabinet. The pair of doors is connected with a linkage assembly that simultaneously opens and closes the pair of doors. The linkage includes features for rotating one door of the pair at a first angular velocity and for rotating another of the pair of doors at a second angular velocity. An angular velocity differential between the first angular velocity and the second angular velocity can limit impacting or rubbing between the pair of doors during simultaneous opening and closing of the pair of doors.

6 Claims, 8 Drawing Sheets

(56) References Cited

U.S. PATENT DOCUMENTS

| | | | | | |
|---|---|---|---|---|---|
| 3,380,110 | A * | 4/1968 | Daugirdas | E05F 3/02 | 16/66 |
| 3,815,514 | A * | 6/1974 | Heap | B61D 7/26 | 105/240 |
| 3,916,965 | A * | 11/1975 | Attridge | B27C 5/003 | 144/117.3 |
| 4,146,994 | A * | 4/1979 | Williams | E05B 63/20 | 49/367 |
| 4,265,051 | A * | 5/1981 | Williams | E05F 5/12 | 49/367 |
| 4,619,076 | A * | 10/1986 | Livingston | A62C 2/248 | 49/367 |
| 5,722,202 | A * | 3/1998 | Cooper | E05F 17/004 | 49/109 |
| 8,226,180 | B2 * | 7/2012 | Patil | E05F 17/004 | 312/324 |
| 8,336,535 | B2 * | 12/2012 | Larsen | F24C 15/021 | 110/173 R |
| 9,255,712 | B2 * | 2/2016 | Yantis | F24C 15/02 | |
| 2003/0150315 | A1 * | 8/2003 | Lin | B21D 28/002 | 83/628 |
| 2006/0108361 | A1 * | 5/2006 | Seiter | B65D 90/008 | 220/1.5 |
| 2007/0039605 | A1 * | 2/2007 | Larsen | F24C 15/023 | 126/191 |
| 2009/0145031 | A1 | 6/2009 | Collene | | |
| 2014/0069408 | A1 * | 3/2014 | Yantis | F24C 15/023 | 126/190 |
| 2014/0069409 | A1 * | 3/2014 | Yantis | F24C 15/02 | 126/198 |
| 2014/0070685 | A1 * | 3/2014 | Yantis | F24C 15/02 | 312/319.2 |

* cited by examiner

OVEN APPLIANCE WITH DUAL OPENING AND CLOSING DOORS

FIELD OF THE INVENTION

The present subject matter relates generally to oven appliances, e.g., French door oven appliances.

BACKGROUND OF THE INVENTION

Oven appliances generally include a cabinet that defines a chamber for receipt of food items for cooking The oven appliance's cabinet also defines an opening that provides for access to the chamber of the cabinet. A door or doors mounted at the opening of the cabinet can selectively limit access to the chamber of the cabinet. As an example, an oven appliance can include a pair of doors rotatably mounted at the opening of the cabinet. Such oven appliances are generally referred to as French door oven appliances.

Certain French door oven appliances include a linkage assembly that connects the oven appliance's pair of doors such that the doors open and close simultaneously. Such a configuration can be useful. For example, the pair of doors can each include a handle. By providing a linkage assembly that connects the pair of doors, a user can pull on either handle in order to open or close both of the doors simultaneously. Thus, a user holding food items in one hand can open or close both doors with the other free hand.

However, French door oven appliances can have certain drawbacks. For example, the doors can collide or rub when both doors of the pair of doors open and close simultaneously. More specifically, sidewalls of the pair of doors can impact during simultaneous opening and closing of the pair of doors. Such impacting and/or rubbing can damage the doors or a gasket positioned on the doors' sidewalls and thereby negatively impact oven appliance performance or user satisfaction with the appliance.

Accordingly, an oven appliance with features for limiting impacting or rubbing between a pair of doors during simultaneous opening and closing of the pair of doors would be useful.

BRIEF DESCRIPTION OF THE INVENTION

The present subject matter provides an oven appliance with a cabinet that defines a chamber for cooking food items. A pair of doors is rotatably mounted to provide selective access to the chamber of the cabinet. The pair of doors is connected with a linkage assembly that simultaneously opens and closes the pair of doors. The linkage includes features for rotating one door of the pair at a first angular velocity and for rotating another of the pair of doors at a second angular velocity. An angular velocity differential between the first angular velocity and the second angular velocity can limit impacting or rubbing between the pair of doors during simultaneous opening and closing of the pair of doors. Additional aspects and advantages of the invention will be set forth in part in the following description, or may be apparent from the description, or may be learned through practice of the invention.

In a first exemplary embodiment, an oven appliance is provided. The oven appliance includes a cabinet that defines a chamber for receipt of food items for cooking The chamber is accessible through an opening defined by the cabinet. The oven appliance also includes a heating element for providing heat to the food items for cooking in the chamber of the cabinet. A pair of doors is rotatably mounted proximate the opening of the cabinet. The pair of doors is rotatable between an open position and a closed position in order to permit selective access to the chamber of the cabinet through the opening of the cabinet. A linkage assembly couples the pair of doors together. The linkage assembly includes a pair of gears. Each gear of the pair of gears has an axis of rotation about which the gear is rotatable. Each axis of rotation defines a circumferential direction and a radial direction. Each gear of the pair of gears has a first engagement edge and a second engagement edge spaced apart along the radial direction from the axis of rotation. The first engagement edge is spaced apart along the radial direction from the second engagement edge. The first engagement edge is located in the same plane as the second engagement edge. Each gear of the pair of gears has a plurality of teeth. The plurality of teeth has a first set of teeth and a second set of teeth. The first set of teeth is positioned on the first engagement edge. The second set of teeth is positioned on the second engagement edge. The plurality of teeth of one of the pair of gears engages the plurality of teeth of the other of the pair of gears. The linkage assembly also includes a pair of linkage arms. Each linkage arm of the pair of linkage arms extends between and connects one of the pair of doors and one of the pair of gears.

In a second exemplary embodiment, an oven appliance is provided. The oven appliance includes a cabinet that defines a chamber for receipt of food items for cooking The chamber is accessible through an opening defined by the cabinet. The oven appliance also includes a heating element for providing heat to the food items for cooking in the chamber of the cabinet. A pair of doors is rotatably mounted proximate the opening of the cabinet. The pair of doors is rotatable between an open position and a closed position in order to permit selective access to the chamber of the cabinet through the opening of the cabinet. A linkage assembly couples the pair of doors together. The linkage assembly includes a pair of gears. Each gear of the pair of gears has an axis of rotation about which the gear is rotatable. Each axis of rotation defines a radial direction. Each gear of the pair of gears has a plurality of teeth. The plurality of teeth of one of the pair of gears engages the plurality of teeth of the other of the pair of gears. Each gear of the pair of gears has an engagement surface that is spaced apart from the axis of rotation of the gear along the radial direction. The plurality of teeth is disposed on the engagement surface. The engagement surface has a first portion and a second portion. The first portion of the engagement surface is spaced apart from the axis of rotation of the gear along the radial direction by a first distance. The second portion of the engagement surface is spaced apart from the axis of rotation of the gear along the radial direction by a second distance. The first distance is different than the second distance. The linkage assembly also includes a pair of linkage arms. Each linkage arm of the pair of linkage arms extends between and connects one of the doors and one of the pair of gears.

In a third exemplary embodiment, an oven appliance is provided. The oven appliance includes a cabinet that defines a chamber for receipt of food items for cooking The chamber is accessible through an opening defined by the cabinet. The oven appliance also includes a heating element for providing heat to the food items for cooking in the chamber of the cabinet. A pair of doors is mounted proximate the opening of the cabinet. Each one of the doors has an axis of rotation about which the doors are rotatable so as to open or close access to the chamber of the cabinet through the opening of the cabinet. The oven appliance also includes a pair of bevel gears. Each one of the bevel gears is connected with one of the doors and positioned along the axis of rotation of the doors so as to rotate with the doors. At least one of the pair of bevel gears is non-circular. A connecting member extends between and is in contact with the pair of bevel gears such that rotation of either one of the doors about the axis of rotation is transferred through the connecting member to the other of the doors.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

In FIG. 4, the pair of doors is shown in a closed position. In FIG. 6, the pair of doors is shown in an open position. In FIG. 5, the pair of doors is shown in a partially opened position between the closed position shown in FIG. 4 and the open position shown in FIG. 6.

DETAILED DESCRIPTION

Figure 1:
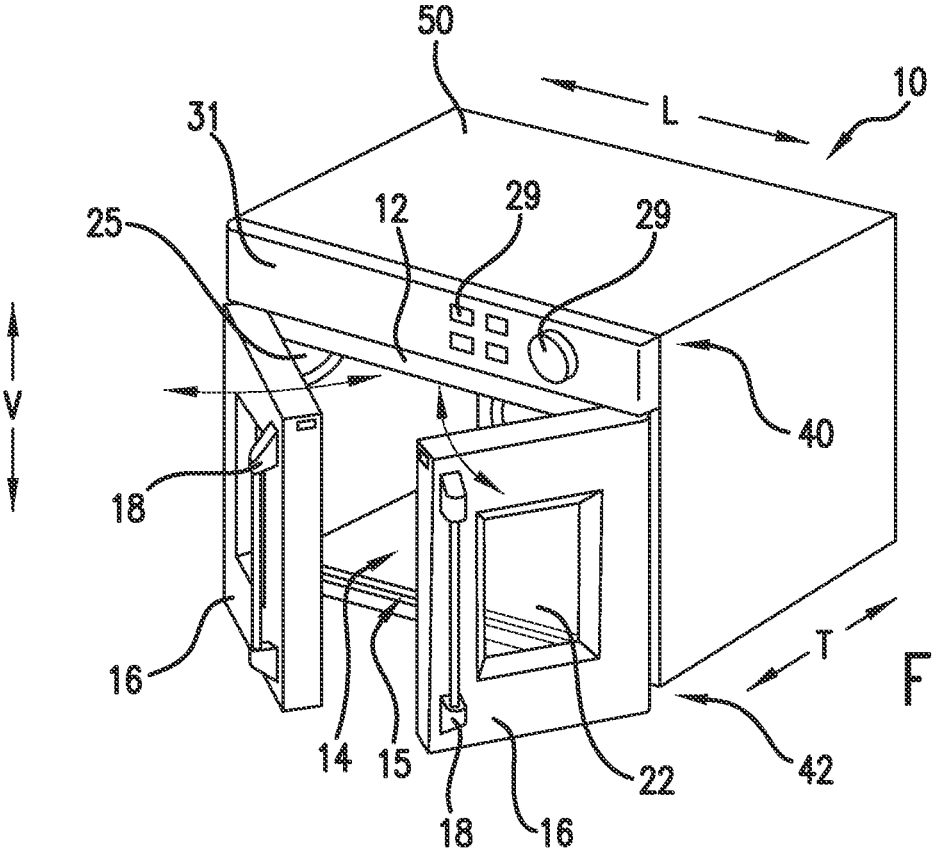
FIG. 1 provides a front perspective view of an oven appliance according to an exemplary embodiment of the present subject matter and, in particular, illustrates a pair of doors of the oven appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
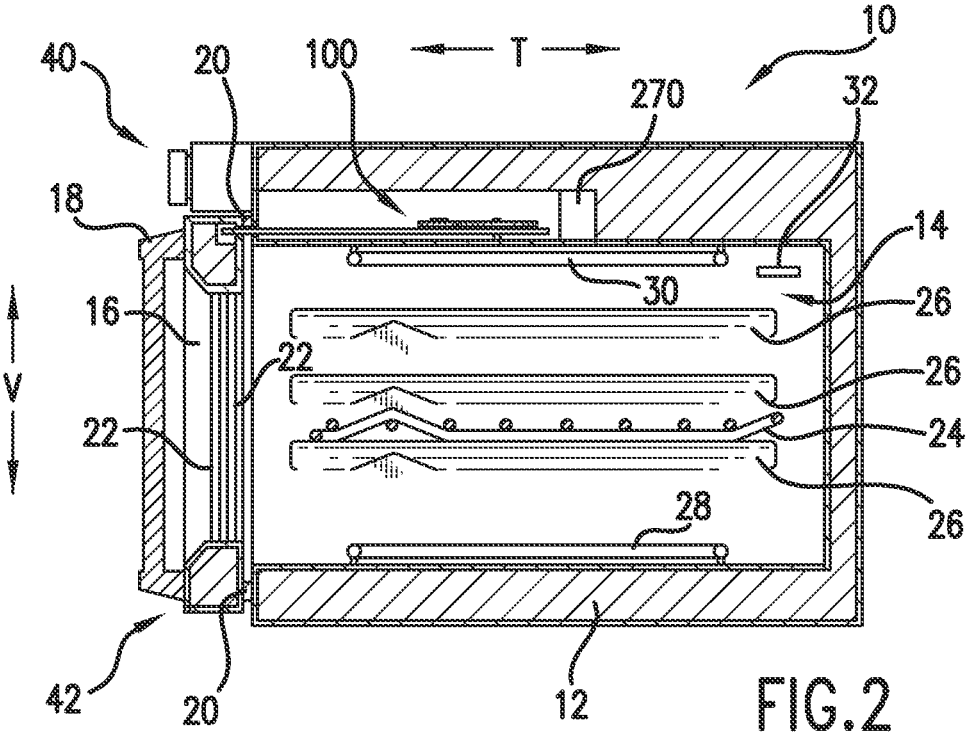
FIG. 2 provides a side cross-sectional view of the oven appliance of FIG. 1 and, in particular, illustrates an exemplary embodiment of a linkage assembly that connects the pair of doors such that each door of the pair of doors rotates open and closed simultaneously.

FIGS. 1 and 2 illustrate an oven appliance 10 according to an exemplary embodiment of the present subject matter. Oven appliance 10 includes an insulated cabinet 12 with an interior surface 25 that defines an interior cooking chamber 14. Cooking chamber 14 is configured for the receipt of one or more food items to be cooked.

Cabinet 12 defines a vertical direction V, a lateral direction L, and a transverse direction T. The vertical direction V, the lateral direction L, and the transverse direction T are mutually perpendicular and form an orthogonal direction system. Cabinet 12 extends between a top 40 and a bottom 42 along the vertical direction V.

Oven appliance 10 includes a pair of doors 16, sometimes referred to as "French doors," rotatably mounted to cabinet 12 proximate an opening 15 to cooking chamber 14. Thus, oven appliance 10 is sometimes referred to as a French door style oven appliance. Pair of doors 16 is configured for selectively shifting between an open configuration shown in FIG. 1 in which a user can access cooking chamber 14 and a closed configuration shown in FIG. 2 in which the user is impeded from accessing cooking chamber 14 by pair of doors 16. Handles 18 are attached to each door of pair of doors 16 and allow for opening and/or closing one or both of the pair of doors 16.

One or more seals 20 between pair of doors 16 and cabinet 12 provide for maintaining heat and cooking fumes within cooking chamber 14 when pair of doors 16 is closed as shown in FIG. 2. Glass panes 22 provide for viewing the contents of cooking chamber 14 when pair of door 16 is closed as well as providing insulation between cooking chamber 14 and the exterior of oven appliance 10. A rack 24 is positioned in cooking chamber 14 for supporting food items thereon. Rack 24 is slidably received onto ribs or rails 26 such that rack 24 may be conveniently moved into and out of cooking chamber 14 when pair of door 16 is open. Multiple rails 26 are provided so that the height of rack 24 may be adjusted.

Heating elements or sources 28 and 30 are positioned within cooking chamber 14 of cabinet 12. Heating elements 28 and 30 are used to heat cooking chamber 14 for both cooking and cleaning of oven appliance 10. While electrically-resistive heating elements 28 and 30 are shown, the present subject matter may be used with other heating elements as well such as gas burners or microwave elements.

The operation of oven appliance 10 including heating elements 28 and 30 is controlled by one or more processing devices (not shown), e.g., a microprocessor. User manipulated controls 29 on control panel 31 allow the user to make selections regarding temperature, time, and other options. The selections can be communicated to the processing device for operation of oven appliance 10. Such processing device is also in communication with a temperature sensor 32 that is used to measure temperature inside cooking chamber 14.

Oven appliance 10 is provided by way of example only. Thus, the present subject matter may be used with other oven configurations, e.g., an oven range. As another example, the present subject matter may be used with an oven defining multiple interior cavities for the receipt of food and/or having different pan or rack arrangements than what is shown in FIG. 2. Heating elements at the top, back, or sides of cooking chamber 14 may also be provided. The present subject matter may also be used with ovens having a variety of different types of heating elements such as microwave, halogen, gas fuel, electrical resistance, and combinations thereof. Pair of doors 16 may also be mounted to cabinet 12 in any other suitable manner or configuration. Other configurations may also be used as will be understood by one of skill in the art using the teachings disclosed herein.

As may be seen in FIG. 2, a linkage assembly 100 is positioned at top 40 of cabinet 12. Linkage assembly 100 connects pair of doors 16 such that pair of doors 16 rotate open and closed simultaneously. Thus, for example, a user may pull on one of handles 18 in order to open both doors of pair of doors 16. Linkage assembly 100 is discussed in greater detail below.

Figure 3:
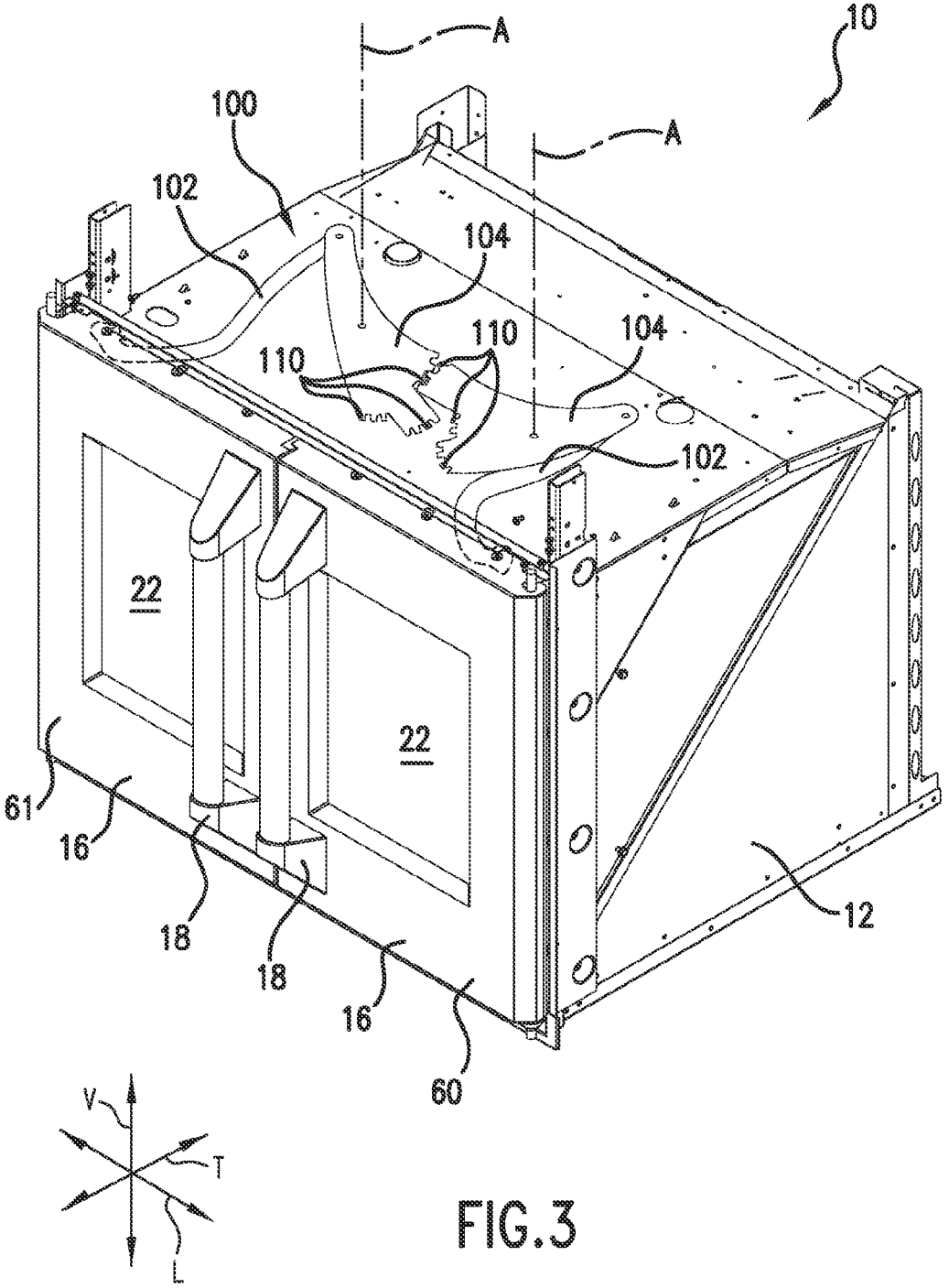
FIG. 3 provides a perspective view of the oven appliance of FIG. 1 with a hood of the cabinet removed to show the linkage assembly of the oven appliance.

FIG. 3 provides a perspective view of the oven appliance of FIG. 1 with a hood of the cabinet removed to show linkage assembly 100 of oven appliance 10. As may be seen in FIG. 3, linkage assembly 100 includes a pair of gears 104. Each gear of pair of gears 104 has an axis of rotation A about which the gear is rotatable. Each axis of rotation A defines a radial direction R and a circumferential direction C. The gears of pair of gears 104 engage one another to transfer rotational motion between pair of doors 16. In particular, each gear of pair of gears 104 includes a plurality of teeth 110. The plurality of teeth 110 of one gear of pair of gears 104 engages the plurality of teeth 110 of the other gear of pair of gears 104 to transfer rotational motion between gears of pair of gears 104.

Linkage assembly 100 also includes a pair of linkage arms 102. Each linkage arm of pair of linkage arms 102 extends between and connects one of the pair of doors 16 and one of the pair of gears 104, e.g., to transfer rotational motion between pair of doors 16 and pair of gears 104 during opening and closing of pair of doors 16 as described in greater detail below.

Figure 4:
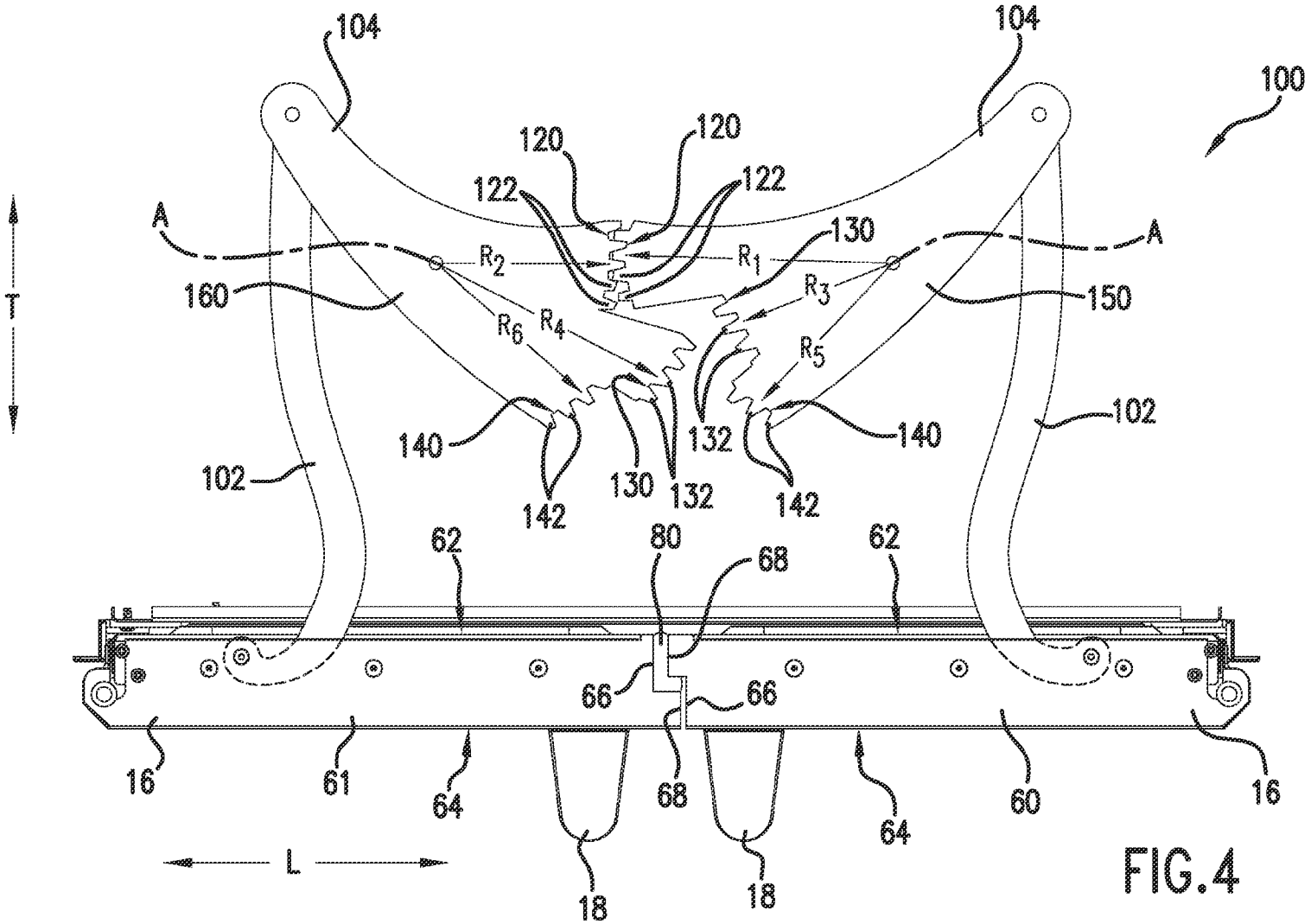
FIGS. 4-6 illustrate the pair of doors and the linkage assembly removed from the oven appliance of FIG. 1 for clarity.
Figure 5:
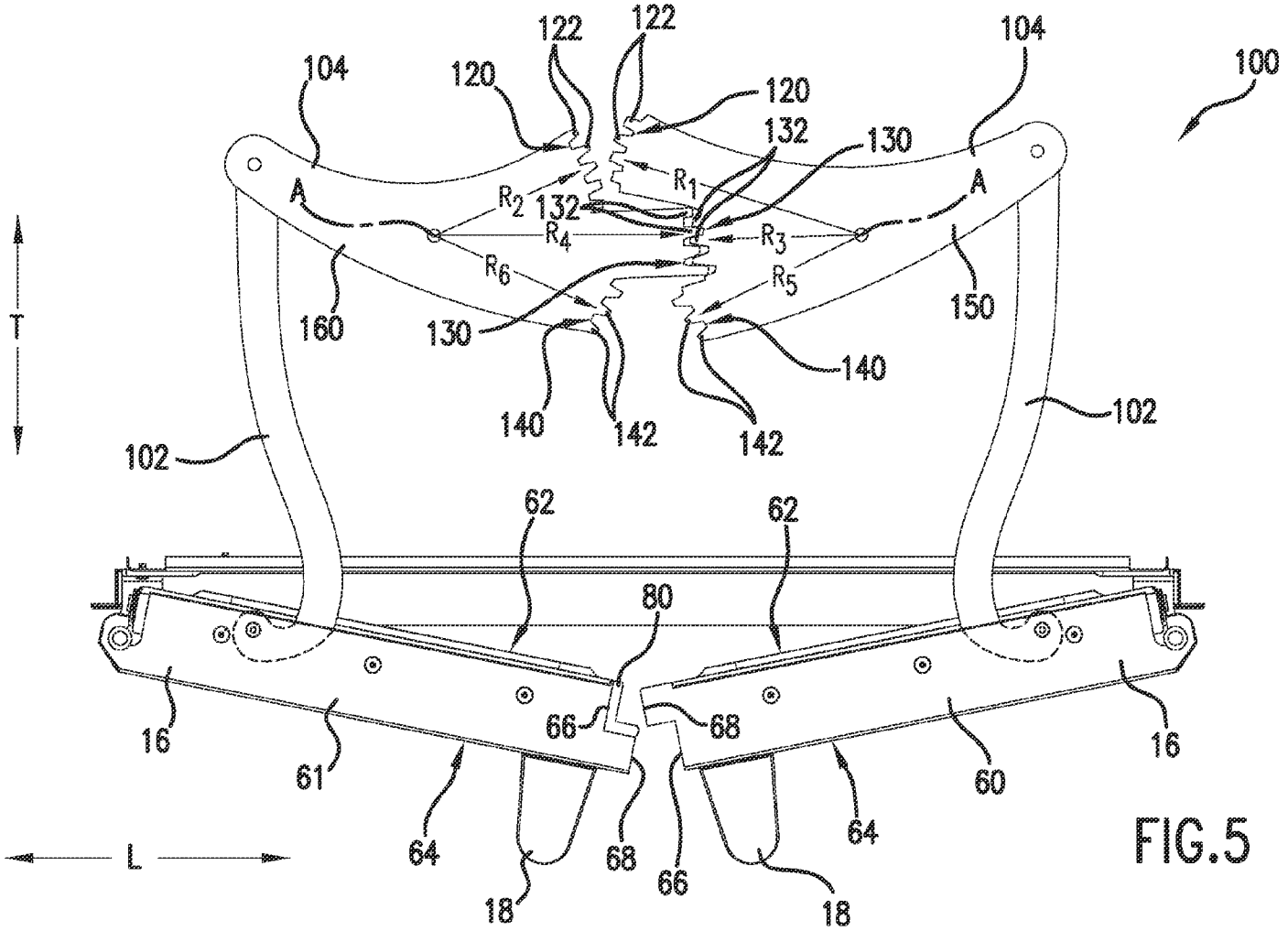
Figure 6:
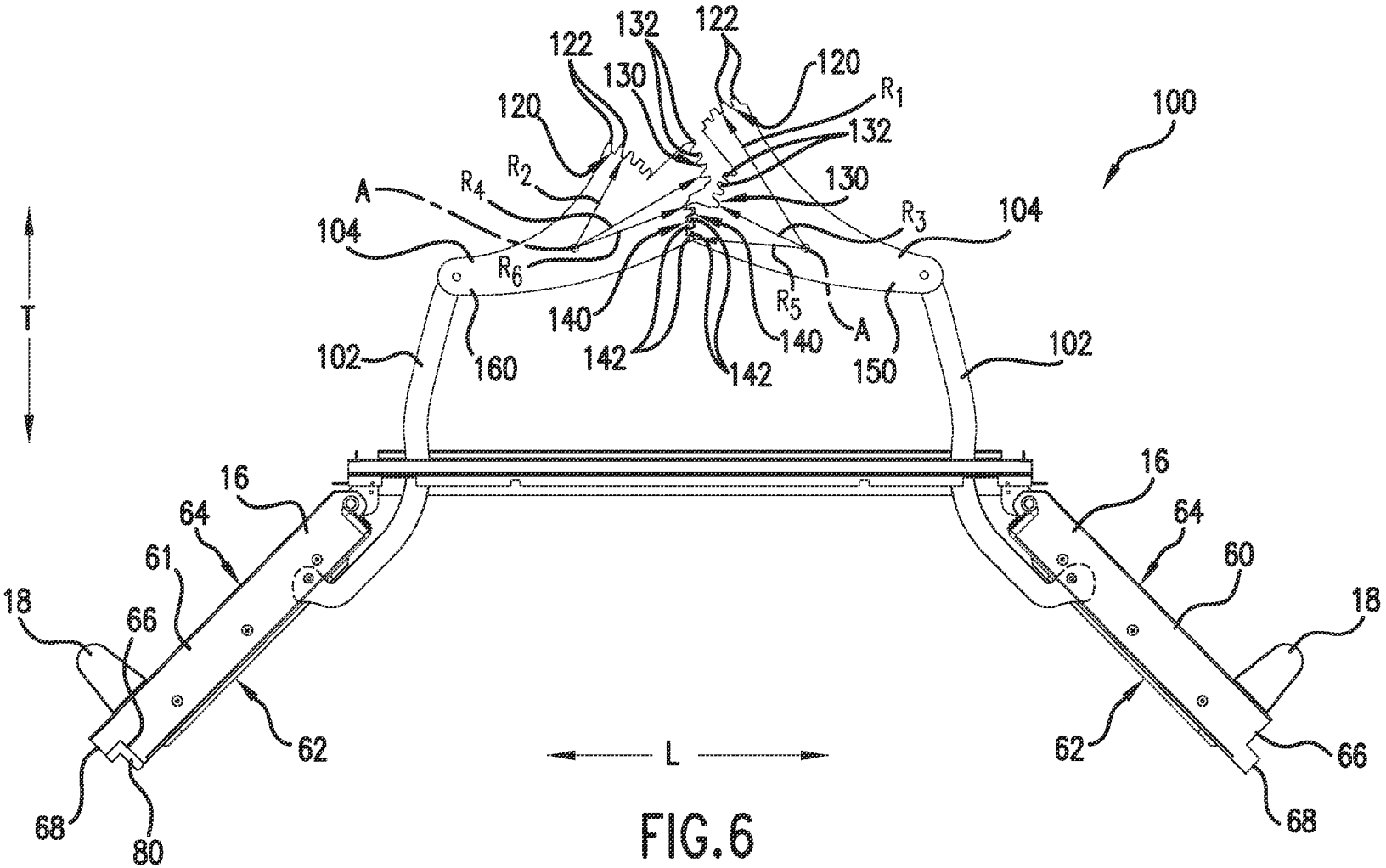

FIGS. 4-6 illustrate pair of doors 16 and linkage assembly 100 removed from oven appliance 10 (FIG. 1) for clarity. In FIG. 4, pair of doors 16 is shown in a closed position. In FIG. 6, pair of doors 16 is shown in an open position. In FIG. 5, pair of doors 16 is shown in a partially opened position between the closed position shown in FIG. 4 and the open position shown in FIG. 6.

As may be seen in FIG. 4, pair of doors 16 includes a first door 60 and a second door 61. First and second doors 60 and 61 each have an inner surface 62 and an outer surface 64 that are spaced apart from one another. A sidewall 66 extends between and connects inner surface 62 and outer surface 64. A projection 68 is positioned on and extends away from sidewall 66. Projection 68 of first door 60 is positioned contiguous with inner surface 62 of first door 60. Conversely, projection 68 of second door 61 is positioned contiguous with outer surface 64 of second door 61. With pair of doors 16 positioned in the closed position as shown in FIG. 4, projection 68 of first door 60 and projection 68 of second door 61 engage one another to form a lap joint interface between first and second doors 60 and 61.

A gasket 80 is mounted to second door 61. Gasket 80 extends between the sidewalls 66 of first door 60 and second door 61 when first and second doors 60 and 61 are in the closed position as shown in FIG. 4. Gasket 80 improves sealing of cooking chamber 14 as will be understood by those skilled in the art.

As may be seen in FIG. 4, each gear of pair of gears 104 has a first engagement edge 120 and a second engagement edge 130. First and second engagement edges 120 and 130 are radially, e.g., along the radial direction R, spaced apart from the axis of rotation A. First and second engagement edges 120 and 130 are also circumferentially, e.g., along the circumferential direction C, spaced apart from one another about the axis of rotation A. First and second engagement edges 120 and 130 are substantially coplanar such that first and second engagement edges 120 and 130 are located or positioned in the same plane.

As discussed above, each gear of pair of gears 104 also has a plurality of teeth 110 (FIG. 3). Plurality of teeth 110 includes a first set of teeth 122 and a second set of teeth 132. First set of teeth 122 is positioned on and extends, e.g., radially, from first engagement edge 120. Similarly, second set of teeth 132 is positioned on and extends, e.g., radially, from second engagement edge 130.

Each gear of pair of gears 104 also has a third engagement edge 140. Like first and second engagement edges 120 and 130, third engagement edge 140 is radially spaced apart from the axis of rotation A. Third engagement edge 140 is also circumferentially spaced apart from both first and second engagement edges 120 and 130 about the axis of rotation A. In addition, first, second, and third engagement edges 120, 130, and 140 are spaced apart from one another along the radial direction R. Plurality of teeth 110 (FIG. 3) also includes a third set of teeth 142 that is position on and extends, e.g., radially, from third engagement edge 140.

While shown in FIG. 4 with three engagement edges 120, 130, and 140, it should be understood that each gear of pair of gears 104 need not include third engagement edge 140 and third set of teeth 142 in alternative exemplary embodiments. Conversely, in additional alternative embodiments, each gear of pair of gears 104 may include any suitable number of additional engagement edges and sets of teeth, e.g., one, two, three, or more engagement edges and sets of teeth. Such additional engagement edges and sets of teeth can, e.g., improve performance of linkage assembly 100 and/or reduce chatter within pair of gears 104 during rotation of pair of doors 16.

Linkage assembly 100 includes features for rotating first and second doors 60 and 61 at different angular velocities, e.g., to prevent or hinder first and second doors 60 and 61 from impacting and/or rubbing during opening and closing of first and second doors 60 and 61. In particular, in the exemplary embodiment shown in FIG. 4, linkage assembly 100 is configured for rotating second door 61 at a greater angular velocity relative to first door 60 as first and second doors 60 and 61 shift from the closed position shown in FIG. 4. Because first and second doors 60 and 61 meet at a lap joint interface when first and second doors 60 and 61 are in the closed position as shown in FIG. 4, rotating second door 61 at a greater angular velocity relative to first door 60 when first and second doors 60 and 61 are shifted from the closed position can hinder or prevent sidewall 66 first door 60 from interfering with or rubbing against projection 68 of second door 61 and/or gasket 80 during such rotation as discussed in greater detail below.

As may be seen in FIG. 4, pair of gears 104 includes a first gear 150 and a second gear 160. First engagement edge 120 of first gear 150 is disposed a first radial distance $R_1$ from axis of rotation A of first gear 150. Conversely, first engagement edge 120 of second gear 160 is disposed a second radial distance $R_2$ from axis of rotation A of second gear 160. In a similar manner, second and third engagement edges 130 and 140 of first gear 150 are disposed a third radial distance $R_3$ and fifth radial distance $R_5$ from axis of rotation A of first gear 150, respectively. Further, second and third engagement edges 130 and 140 of second gear 160 are disposed a fourth radial distance $R_4$ and sixth radial distance $R_6$ from axis of rotation A of second gear 160, respectively.

In the exemplary embodiment shown in FIG. 4, first and second radial distance $R_1$ and $R_2$ are different. In particular, second radial distance $R_2$ is less than first radial distance $R_1$ in FIG. 4. However, in alternative exemplary embodiments, second radial distance $R_2$ may be greater than first radial distance $R_1$. Providing first and second gears 150 and 160 where first and second radial distance $R_1$ and $R_2$ are different can permit first and second doors 60 and 61 to rotate open and closed at different angular speeds and hinder or prevent the first and second doors 60 and 61 from interring with or impacting against each other and/or gasket 80.

Figure 7:
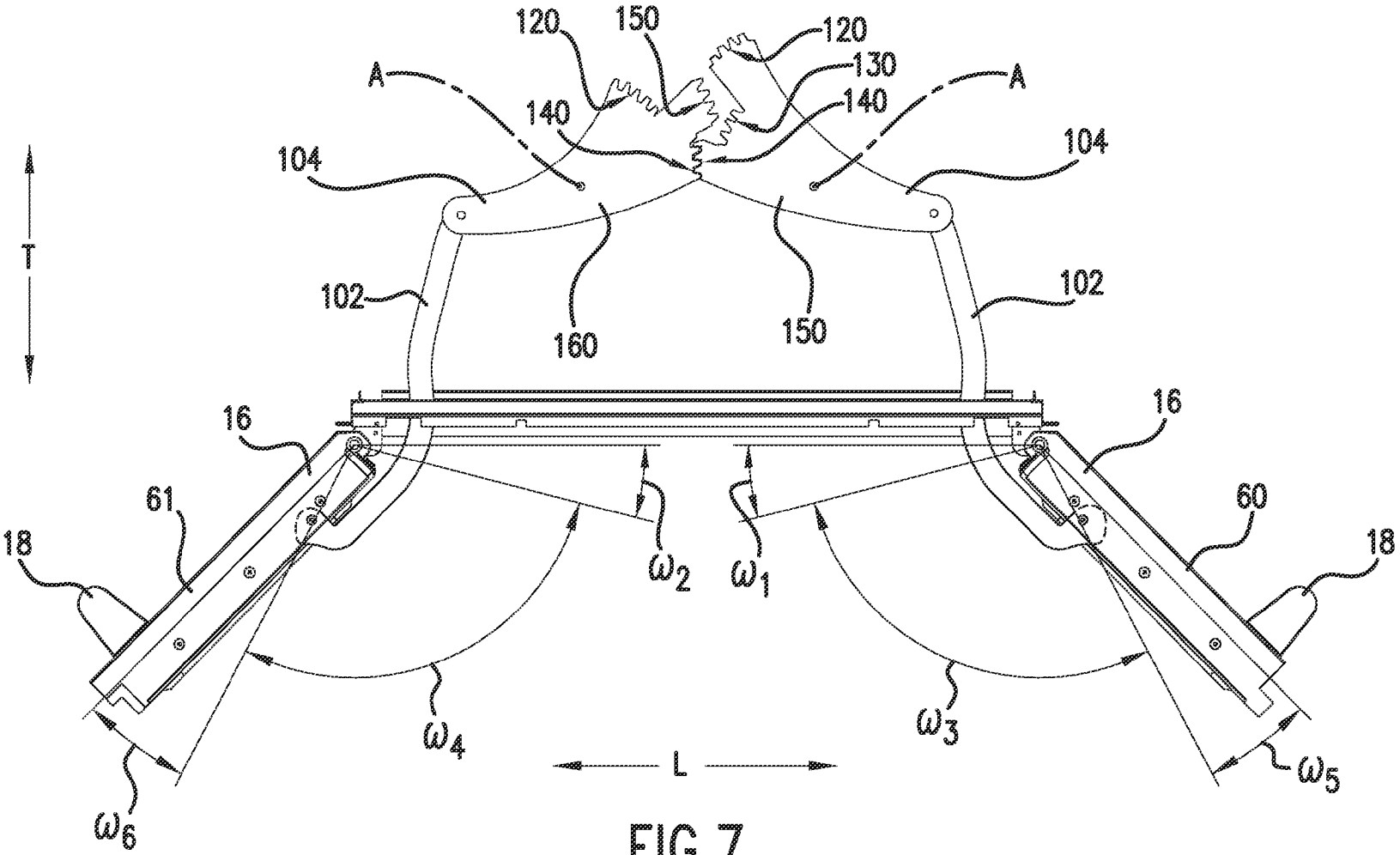
FIG. 7 illustrates the pair of doors and the linkage assembly of FIG. 6. The angular velocities of the pair of doors at various positions are also shown.

As an example, when first and second doors 60 and 61 are in the closed position as shown in FIG. 4, first set of teeth 122 of first gear 150 engages first set of teeth 122 of second gear 160. As discussed above, first and second radial distances $R_1$ and $R_2$ are different. Thus, rotational velocities of first and second doors 60 and 61 are different despite first and second doors 60 and 61 being coupled together with first set of teeth 122 of first gear 150 and first set of teeth 122 of second gear 160. In particular, as shown in FIG. 7, a user may pull on first door 60 and rotate first door 60 at a first angular velocity $\omega_1$. When first door 60 is rotated at first angular velocity $\omega_1$, linkage assembly 100 causes second door 61 to rotate at a second angular velocity $\omega_2$.

First and second angular velocities $\omega_1$ and $\omega_2$ are different, e.g., because first and second radial distances $R_1$ and $R_2$ are different. Rotating second door 61 at a different, e.g., greater, angular velocity relative to first door 60 can hinder or prevent first door 60 from interfering with or rubbing against second door 61 and/or gasket 80 during open and closing of first and second doors 60 and 61. As an example, second angular velocity $\omega_2$ may be about twenty five percent greater than first angular velocity $\omega_1$. However, as will be understood by those skilled in the art, first and second angular velocities $\omega_1$ and $\omega_2$ may vary by any suitable amount, e.g., depending upon first and second radial distances $R_1$ and $R_2$ selected for first and second gears 150 and 160, respectively.

As first and second doors 60 and 61 rotate open from the closed position shown in FIG. 4 to the partially open position shown in FIG. 5, second set of teeth 132 of first gear 150 engages second set of teeth 132 of second gear 160. As may be seen in FIG. 5, third and fourth radial distances $R_3$ and $R_4$ are different. Thus, rotational velocities of first and second doors 60 and 61 may be different when second set of teeth 132 of first gear 150 engages second set of teeth 132 of second gear 160. In particular, as shown in FIG. 7, the user may pull on first door 60 and rotate first door 60 at a third angular velocity $\omega_3$. When first door 60 is rotated at third angular velocity $\omega_3$, linkage assembly 100 causes second door 61 to rotate at a fourth angular velocity $\omega_4$.

Third and fourth angular velocities $\omega_3$ and $\omega_4$ are different, e.g., because third and fourth radial distances $R_3$ and $R_4$ are different. As an example, third angular velocity $\omega_3$ may be about twenty five percent greater than fourth angular velocity $\omega_4$, e.g., in order for first door 60 to "catch up" with second door 61 or vice versa so that first and second doors 60 and 61 are equally rotated as first and second doors 60 and 61 approach the open position shown in FIG. 6. However, as will be understood by those skilled in the art, third and fourth angular velocities $\omega_3$ and $\omega_4$ may vary by any suitable amount, e.g., depending upon third and fourth radial distances $R_3$ and $R_4$ selected for first and second gears 150 and 160, respectively.

As first and second doors 60 and 61 rotate open from partially open position shown in FIG. 5 to the open position shown in FIG. 6, third set of teeth 142 of first gear 150 engages third set of teeth 142 of second gear 160. In contrast to first and second radial distances $R_1$ and $R_2$ and third and fourth radial distances $R_3$ and $R_4$, fifth and sixth radial distances $R_5$ and $R_6$ may be equal or about equal. Thus, rotational velocities of first and second doors 60 and 61 may be equal or about equal when third set of teeth 142 of first gear 150 engages third set of teeth 142 of second gear 160. In particular, as shown in FIG. 7, the user may pull on first door 60 and rotate first door 60 at a fifth angular velocity $\omega_5$. When first door 60 is rotated at fifth angular velocity $\omega_5$, linkage assembly 100 causes second door 61 to rotate at a sixth angular velocity $\omega_6$.

Fifth and sixth angular velocities $\omega_5$ and $\omega_6$ may be equal or about equal, e.g., because fifth and sixth radial distances $R_5$ and $R_6$ are about equal or about equal. However, as will be understood by those skilled in the art, fifth and sixth angular velocities $\omega_5$ and $\omega_6$ may vary by any suitable amount, e.g., depending upon fifth and sixth radial distances $R_5$ and $R_6$ selected for first and second gears 150 and 160, respectively.

Figure 8:
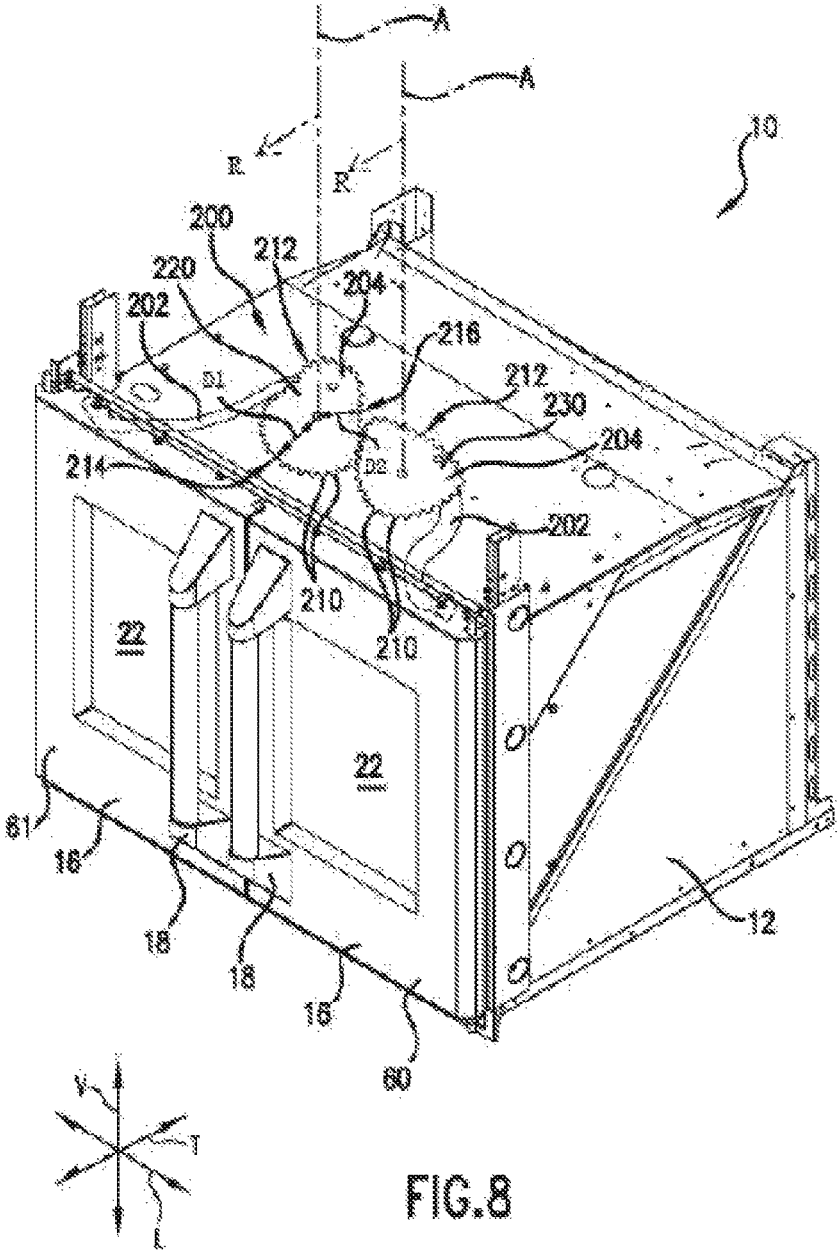
FIG. 8 provides a perspective view of the oven appliance of FIG. 1 with the hood of the cabinet removed to show an alternative linkage assembly according to an exemplary embodiment of the present subject matter.

FIG. 8 provides a perspective view of oven appliance 10 with hood 50 of cabinet 12 removed to show an alternative linkage assembly 200 according to an exemplary embodiment of the present subject matter. Like linkage assembly 100 (FIG. 3), linkage assembly 200 includes features for rotating first and second doors 60 and 61 at different angular velocities, e.g., to prevent or hinder first and second doors 60 and 61 from impacting and/or rubbing during opening and closing of first and second doors 60 and 61.

Linkage assembly 200 includes a pair of gears 204. Each gear of pair of gears 204 has an axis of rotation A about which the gear is rotatable. Each axis of rotation A defines a radial direction R and a circumferential direction C. The gears of pair of gears 204 engage one another to transfer rotational motion of pair of doors 16. In particular, each gear of pair of gears 204 includes a plurality of teeth 210. The plurality of teeth 210 of one gear of pair of gears 204 engages the plurality of teeth 210 of the other gear of pair of gears 204 to transfer rotational motion between gears of pair of gears 204.

Linkage assembly 200 also includes a pair of linkage arms 202. Each linkage arm of pair of linkage arms 202 extends between and connects one of the pair of doors 16 and one of the pair of gears 204, e.g., to transfer rotational motion between pair of doors 16 and pair of gears 204 during opening and closing of pair of doors 16.

As may be seen in FIG. 8, each gear of pair of gears 204 has an engagement edge 212. Engagement edge 212 is radially, e.g., along the radial direction R, spaced apart from the axis of rotation A. Engagement edge 212 of each gear 204 has a first portion 214 and a second portion 216. First portion 214 of engagement edge 212 is circumferentially, e.g., along the circumferential direction C, spaced apart from second portion 216 of engagement edge 212 about the axis of rotation A.

First portion 214 of engagement edge 212 is disposed a first distance $D_1$ from axis of rotation A, e.g., along the radial direction R. Conversely, second portion 216 of engagement edge 212 is disposed a second distance $D_2$ from axis of rotation A, e.g., along the radial direction R. In other words, first portion 214 of engagement edge 212 is radially spaced apart from second portion 216 of engagement edge 212.

Thus, each gear of pair of gears 204 is non-circular, e.g., in order to rotate first and second doors 60 and 61 at different angular velocities during opening and closing of first and second doors 60 and 61 in a similar manner to linkage assembly 100 described above. However, each gear of pair of gears 204 has a continuous engagement edge rather than discrete engagement edges like each gear of pair of gears 104 (FIG. 4). Such continuous engagement edge can, e.g., provide reduced chatter for pair of gears 204 relative to pair of gear 104 (FIG. 3).

In the exemplary embodiment shown in FIG. 8, pair of gears 204 includes a first gear 220 and a second gear 230. First and second gears 220 and 230 are non-circular. For example, first gear 220 is pear shaped and second gear 230 is D shaped in the exemplary embodiment shown in FIG. 8. However, in alternative exemplary embodiments, first and second gears 220 and 230 may have any suitable shape for rotating first and second doors 60 and 61 at different angular velocities. As discussed above, each gear of pair of gears 204 also has a plurality of teeth 210. Plurality of teeth 210 is positioned on and extends, e.g., radially, from engagement edge 212.

Figure 9:
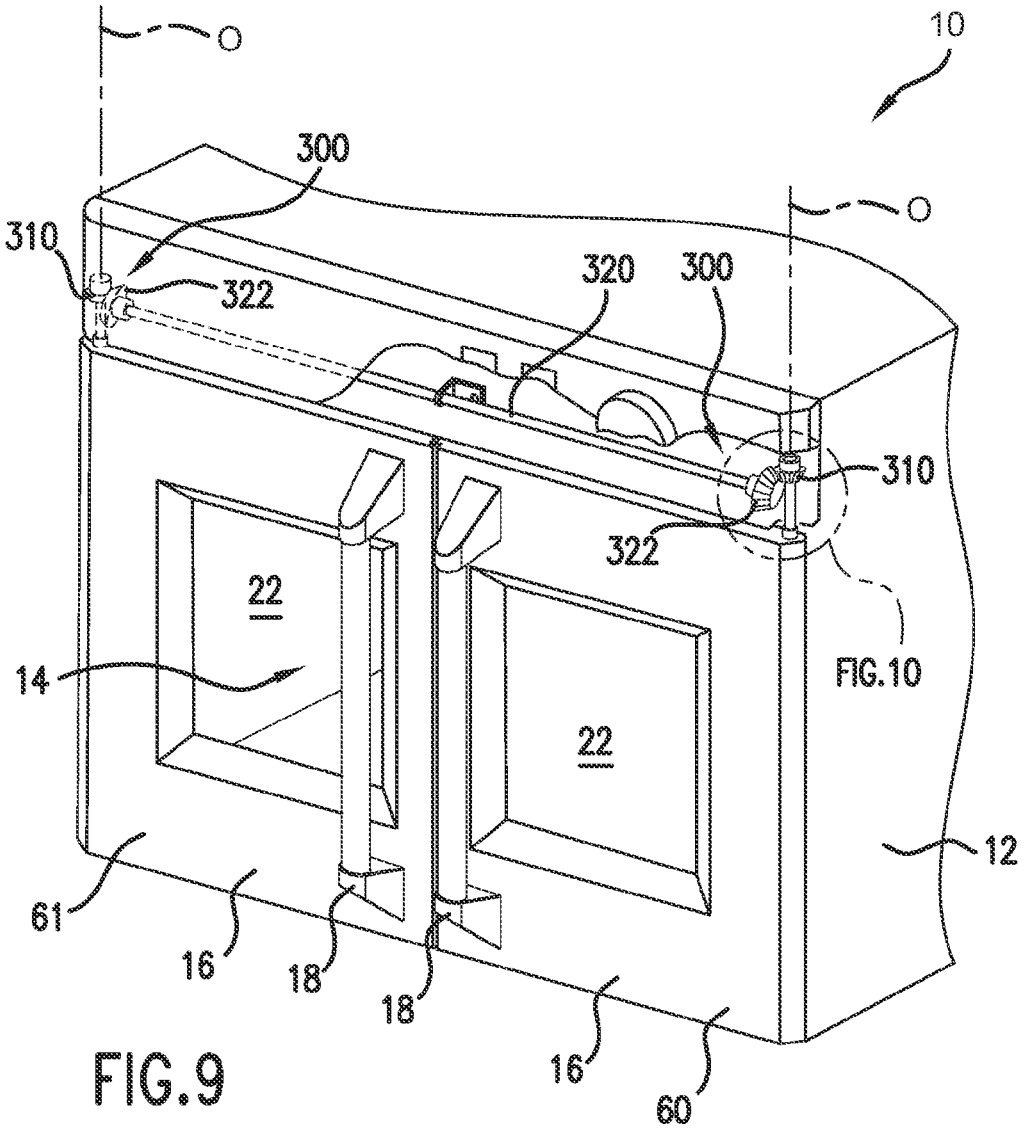
FIG. 9 provides a perspective view of the oven appliance of FIG. 1 with portions of the cabinet removed to show an additional, alternative linkage assembly according to an exemplary embodiment of the present subject matter.

FIG. 9 provides a partial, perspective view of oven appliance 10 with portions of cabinet 12 removed to show an additional, alternative linkage assembly 300 according to an exemplary embodiment of the present subject matter. Like linkage assemblies 100 (FIG. 3) and 200 (FIG. 8), linkage assembly 300 includes features for rotating first and second doors 60 and 61 at different angular velocities, e.g., to prevent or hinder first and second doors 60 and 61 from impacting and/or rubbing during opening and closing of first and second doors 60 and 61.

As may be seen in FIG. 9, each door of pair of doors 16 has an axis of rotation O. Linkage assembly 300 includes a pair of bevel gears 310. Each one of the bevel gears 310 is connected with one of the pair of doors 16 and is positioned along the axis of rotation O of the door 16 so as to rotate with the door 16. At least one of the pair of bevel gears 310 is non-circular. In particular, as may be seen in FIG. 10, each gear of pair of bevel gears 310 is an oval bevel gear. However, in alternative exemplary embodiments, gears of pair of bevel gears 310 may have any suitable shape for rotating first and second doors 60 and 61 at different angular velocities.

Figure 10:
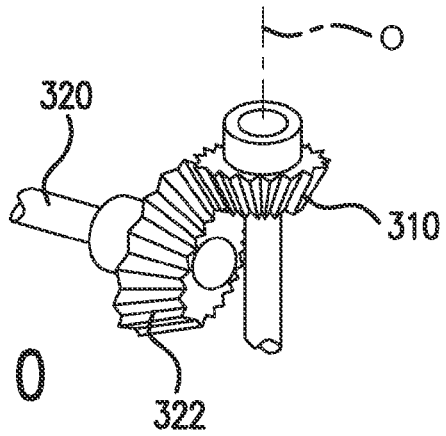
FIG. 10 illustrates bevel gears of the additional, alternative linkage assembly of FIG. 9 according to an exemplary embodiment of the present subject matter.

A connecting member 320 extends between and is in contact with pair of bevel gears 310 such that rotation of either door of pair of doors 16 about the axis of rotation O is transferred through connecting member 320 to the other door of pair of doors 16 in order to rotate the pair of doors 16 simultaneously. In particular, connecting member 320 includes additional bevel gears 322 for engaging bevel gears 310. Additional bevel gears may be oval bevel gears as shown in FIG. 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cabinet defining a chamber for receipt of food items for cooking, the chamber accessible through an opening defined by said cabinet;

a heating element for providing heat to the food items for cooking in the chamber of said cabinet;

a pair of doors rotatably mounted proximate the opening of said cabinet, said pair of doors comprising a first door and a second door, each of said first door and second door being rotatable between an open position and a closed position in order to permit selective access to the chamber of said cabinet through the opening of said cabinet, each of said first door and second door comprising a handle that allows for opening or closing the pair of doors; and a linkage assembly coupling said pair of doors together, said linkage assembly comprising:

a pair of gears, each gear of said pair of gears having an axis of rotation about which the gear is rotatable, each axis of rotation defining a radial direction that is perpendicular to the respective axis of rotation, each gear of said pair of gears having a plurality of teeth, the plurality of teeth of one of said pair of gears engaging the plurality of teeth of the other of said pair of gears, each gear of said pair of gears having an engagement surface spaced apart from the axis of rotation of the gear along the radial direction, the plurality of teeth disposed on the engagement surface, the engagement surface having a first portion and a second portion, the first portion of the engagement surface spaced apart from the axis of rotation of the gear along the radial direction by a first distance, the second portion of the engagement surface spaced apart from the axis of rotation of the gear along the radial direction by a second distance, the first distance being different than the second distance; and a pair of linkage arms, each linkage arm of said pair of linkage arms extending between and connecting one of said pair of doors and one of said pair of gears, wherein said linkage assembly couples said first door to said second door such that said first door rotates at first angular velocity when said second door rotates at a second angular velocity, an absolute value of the first angular velocity being different than an absolute value of the second angular velocity, wherein said first door and said second door each having an inner surface and an outer surface, said first door and said second door each also having a sidewall extending between the inner surface and the outer surface, said first door and said second door each also having a projection that extends away from the sidewall, the projection of said first door and the projection of said second door engaging one another in a lap joint interface when said first and second doors are in the closed position.

2. The oven appliance of claim 1, wherein at least one of said pair of gears is non-circular.

3. The oven appliance of claim 1, wherein the projection of said first door is positioned contiguous with the inner surface of said first door, and the projection of said second door is positioned contiguous with the outer surface of said second door.

4. The oven appliance of claim 1, further comprising a seal disposed between said cabinet and said first and second doors when said first and second doors are in the closed position.

5. The oven appliance of claim 1, wherein the engagement surface is continuous between the first and second portions of the engagement surface.

6. The oven appliance of claim 3, further comprising a gasket disposed between the sidewalls of said first door and said second door when said first and second doors are in the closed position.

* * * * *